US006349643B1

(12) United States Patent
Loftus et al.

(10) Patent No.: US 6,349,643 B1
(45) **Date of Patent: *Feb. 26, 2002**

(54) METHOD AND DEVICE FOR INFLUENCING INK-TRAPPING BEHAVIOR

(75) Inventors: Geoffrey Loftus, Marietta, GA (US); Gotthard Schmid, Malsch; Klaus Sauer, Dielheim-Horrenberg, both of (DE)

(73) Assignee: Heidelberger Druckmaschinen, Heidelberg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 824 days.

(21) Appl. No.: 08/639,426

(22) Filed: Apr. 29, 1996

(30) Foreign Application Priority Data

Apr. 28, 1995 (DE) ..... 195 15 077

(51) Int. Cl.[7] ..... B41F 31/00; B41F 23/04; B41F 1/40

(52) U.S. Cl. ..... 101/351.1; 101/351.4; 101/487; 101/209

(58) Field of Search ..... 101/348, 349–352, 101/207–210, 148, 351.1, 351.2, 351.3, 351.4, 487

(56) References Cited

U.S. PATENT DOCUMENTS

| | | | | | |
|---|---|---|---|---|---|
| 1,301,072 | A | * | 4/1919 | Mascord | 101/219 |
| 3,203,346 | A | * | 8/1965 | Norton et al. | 101/217 |
| 3,563,173 | A | * | 2/1971 | Harless | 101/148 |
| 3,744,414 | A | * | 7/1973 | Krochert | 101/148 |
| 4,007,683 | A | * | 2/1977 | Dickerson | 101/363 |
| 4,290,360 | A | * | 9/1981 | Fischer | 101/148 |
| 4,453,463 | A | * | 6/1984 | Dahlgren et al. | 101/148 |
| 4,567,823 | A | * | 2/1986 | Hummel et al. | 101/148 |
| 5,081,928 | A | * | 1/1992 | Harrison | 101/351 |
| 5,333,548 | A | * | 8/1994 | Fadner | 101/467 |

FOREIGN PATENT DOCUMENTS

| | | |
|---|---|---|
| DE | 2 303 738 | 9/1973 |
| DE | 28 08 856 | 4/1984 |
| DE | 38 40 458 | 6/1990 |

* cited by examiner

*Primary Examiner*—Kimberly L. Asher
(74) *Attorney, Agent, or Firm*—Herbert L. Lerner; Laurence A. Greenberg; Werner H. Stemer

(57) ABSTRACT

Method of influencing ink-trapping behavior of ink-conducting components of a printing unit in a rotary printing press includes disconnecting at a clutch location an inking-unit drive coming from printing-unit cylinders, directly imaging a printing form on a printing-form cylinder within the rotary printing press, and reestablishing the drive connection between the inking unit and the printing-unit cylinders at the clutch location after completing the direct imaging of the printing form; and device for performing the method.

7 Claims, 4 Drawing Sheets

1
2
6
4
5
15
21
3
7.1
7
9
8
13
13
14
10
11
14
12

1
2
6
4
5
3
15
21
7
9
8
13
13
14
10
11
14
12

1
2
6
4
5
3
7
9
8
13
13
21
15
14
10
11
14
12

METHOD AND DEVICE FOR INFLUENCING INK-TRAPPING BEHAVIOR

BACKGROUND OF THE INVENTION

FIELD OF THE INVENTION

The invention relates to a method of influencing ink-trapping behavior of ink-conducting components of a printing unit in a rotary printing press, and a device for implementing the method.

German Patent 23 03 718 which exemplifies the state of the art discloses an ink-supplying arrangement for a printing press, and a method of supplying a rotating printing plate with printing ink. For the purpose of reducing shock in the inking unit and for eliminating slurring in the printed image, a friction drive is provided between rollers of the inking unit, as well as an over-running clutch which engages or becomes active when the speed of the drive is lower than a given working speed.

The published German Patent Document DE 28 08 856 C2 discloses an inking-unit drive for a rotary printing press. Provided with this inking-unit drive is a vibrator roller which is disposed between an ink-duct roller and a first ink-transfer roller, and the drive for the entire inking unit results via gearwheels from drive gears of the plate cylinder and/or the blanket cylinder. A drive gear of a lower ink-transfer roller is directly connected to a main drive shaft, whereas all of the remaining driven inking-unit rollers are connected with a drive gear of the plate cylinder.

The published German Patent Document DE 18 40 458 A1 discloses a printing press have printing-unit cylinders which are movable forwards in an inching mode for mounting or locking the printing plates. With this construction, it is possible to avoid shocks of a form roller drivable by an adjacent printing-unit cylinder from acting upon the drive elements, by providing a clutch in the vicinity of the gear train connecting the form roller to the adjacent printing-unit cylinder, the clutch being automatically disengageable for operating in the inching mode.

Rotary printing presses equipped with units for the direct imaging of the printing forms within the printing units have proven that heating of the printing-form cylinder and the inking unit has extremely undesirable consequences. If the temperature of the printing form or the inking unit is too high as a result of thermal conduction or other forms of heat transfer, the printing form tends to scum, and the ink-trapping behavior thereof deteriorates due to the temperature being too high and due to premature vaporization or evaporation of dampening medium, thus causing a delay in the direct transition into the production printing run.

SUMMARY OF THE INVENTION

It is accordingly an object of the invention to provide a method and device for influencing ink-trapping behavior which are improved over the prior art particularly in printing presses having units for the direct imaging of printing forms within the respective press during the start-up phase.

With the foregoing and other objects in view, there is provided, in accordance with one aspect of the invention, a method of influencing ink-trapping behavior of ink-conducting components of a printing unit in a rotary printing press, which comprises disconnecting at a clutch location an inking-unit drive coming from printing-unit cylinders; directly imaging a printing form on a printing-form cylinder within the rotary printing press; and reestablishing the drive connection between the inking unit and the printing-unit cylinders at the clutch location after completing the direct imaging of the printing form.

In accordance with another aspect of the invention, there is provided, in a rotary printing press, a device for performing a method of influencing ink-trapping behavior of ink-conducting components of a printing unit, comprising a clutch system disconnectably connecting at a clutch location an inking-unit drive coming from printing-unit cylinders of the printing unit, the clutch system including an axially acting clutch.

In accordance with another feature of the invention, the clutch is of a type actuatable by a pressure medium.

In accordance with an alternative feature of the invention, the clutch is an electromagnetically actuatable clutch.

In accordance with a further feature of the invention, the clutch is disposed on a shaft of a distributor roller.

In accordance with an alternative feature of the invention, the clutch is disposed on a control shaft.

In accordance with a concomitant alternative feature of the invention, the clutch is mounted on a journal of a printing-unit cylinder.

In the performance of the method steps mentioned hereinbefore, assurance is offered that the temperature of the printing form is kept constant, without any excessive vaporization which would otherwise falsify the set dampening-medium ratio, and with the production of a considerably smaller number of waste copies prior to starting the production run, because the ink-trapping properties of the printing form eliminate scumming. This considerably improves the productivity of a printing press which is equipped accordingly.

In a device for performing the method according to the invention, a clutch system at a clutch location includes a clutch operatable in axial direction and subjected to a pressure medium, by means of which the inking unit is disconnectable from the drive. Instead of a clutch to which a pressure medium is applied, it is conceivable to provide an electromagnetically actuated clutch. The respective clutch is disposed on a shaft of a distributor roller or drum. Alternatively, the respective clutch is mounted on a transmission shaft, i.e., a control shaft.

Another alternative mounting location for the clutch is the journal of the respective printing-unit cylinder.

Other features which are considered as characteristic for the invention are set forth in the appended claims.

Although the invention is illustrated and described herein as embodied in a method and device for influencing ink-trapping behavior, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENT

Figure 1:
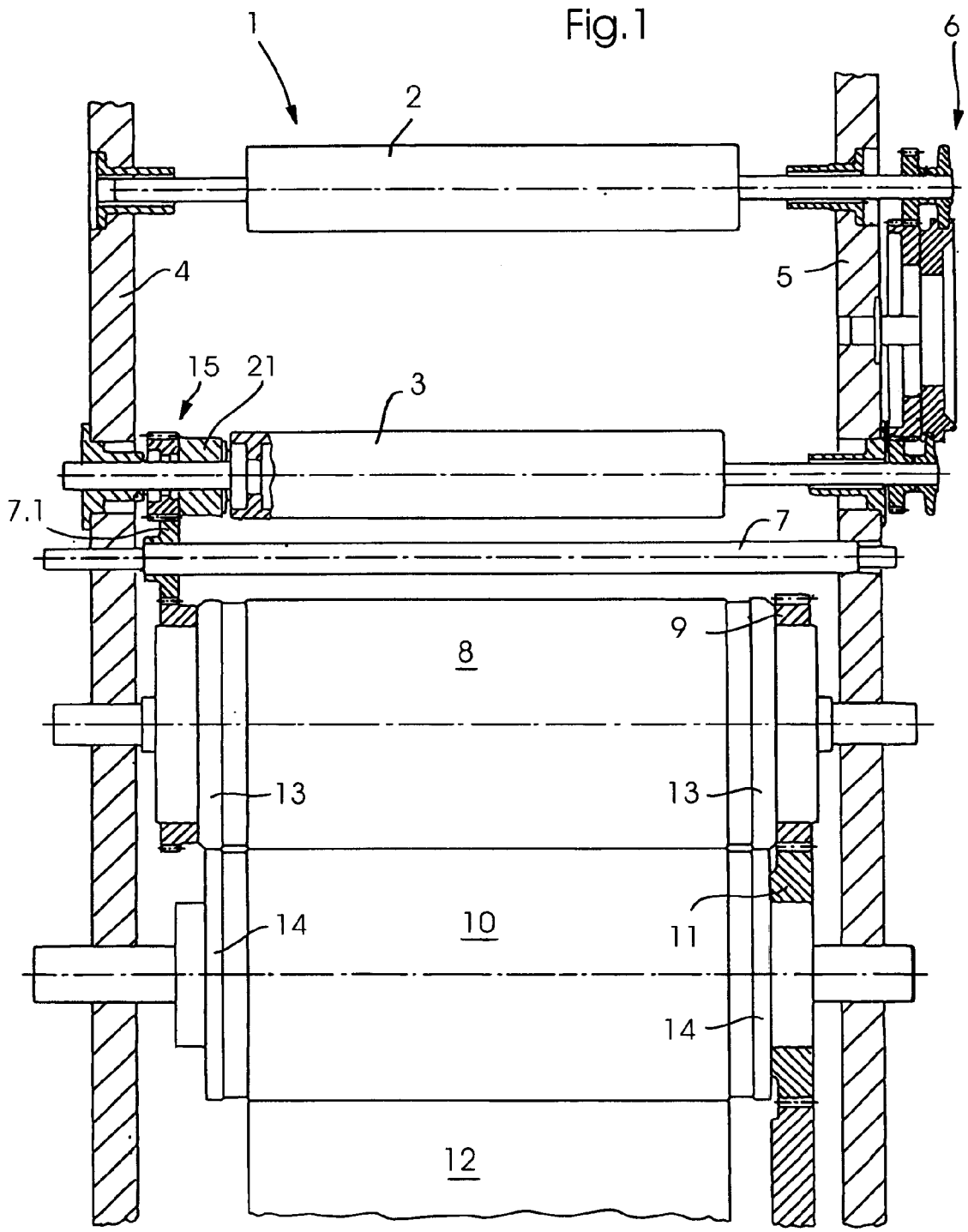
FIG. 1 is a fragmentary sectional view of an inking unit and a printing unit with a clutch system provided, for example, on a distributor roller.

Referring now to the drawings and, first, particularly to FIG. 1 thereof, there is shown therein an inking unit 1 having inking-unit components, such as, distributor rollers 2 and 3, for example, which are supported in side walls 4 and 5 of a rotary printing press. Via a distributor-roller drive 6, motion in an axial direction is imparted to the distributor rollers 2 and 3. The printing-unit cylinders 8, 10 and 12 are illustrated below the inking unit 1. Of the cylinders, the printing-form cylinder 8 cooperates with a transfer cylinder 10 which, in this case, is a blanket cylinder, the material to be printed is conveyed on the circumference of an impression cylinder 12 shown only diagrammatically. The impression cylinder 12 in the illustrated embodiment has an outer cylindrical surface whereon a plurality of copies may be conveyed, and cooperates at the outer cylindrical surface thereof with a plurality of printing-form cylinders and pairs of blanket cylinders. From the cylinder 12, the drive of the aforementioned printing-form cylinder 8 and the transfer cylinder 10 takes place via gearwheels 9 and 11 which mesh with one another on the drive side, i.e., the side wall 5, of the printing press. In order to ensure constant pressing and roll-off conditions between the cylinders 8 and 10, they are equipped with Schmitz or cylinder bearer rings 13 and 14 rolling off on one another.

The imaging units, by means of which a stock of printing-form foils held inside the printing-form cylinder 8 may be conveyed on the circumference of the printing-form cylinder 8 and may be directly imaged in the printing unit, are disposed perpendicularly to the plane of the drawing of FIG. 1 and are therefore not shown.

A gearwheel provided on the printing-form cylinder 8 at the operating side of the printing press in the vicinity of the side wall 4 drives the inking unit 1. That gearwheel meshes with a ratchet wheel 7.1 mounted on the control shaft 7. In the illustrated embodiment, a clutch system 15 is provided on the shaft of the distributor roller 3 and includes a clutch subjected to a pressure medium. During the imaging process of the printing-form cylinder 8, the inking unit 1 may be disengaged from the drive by means of the clutch and, as a result thereof, does not run dry, thereby eliminating the problem of scumming. The ink balance may be maintained, and the freshly imaged printing form may receive the ink directly from the inking unit without having first to produce a large number of waste copies.

Figure 3:
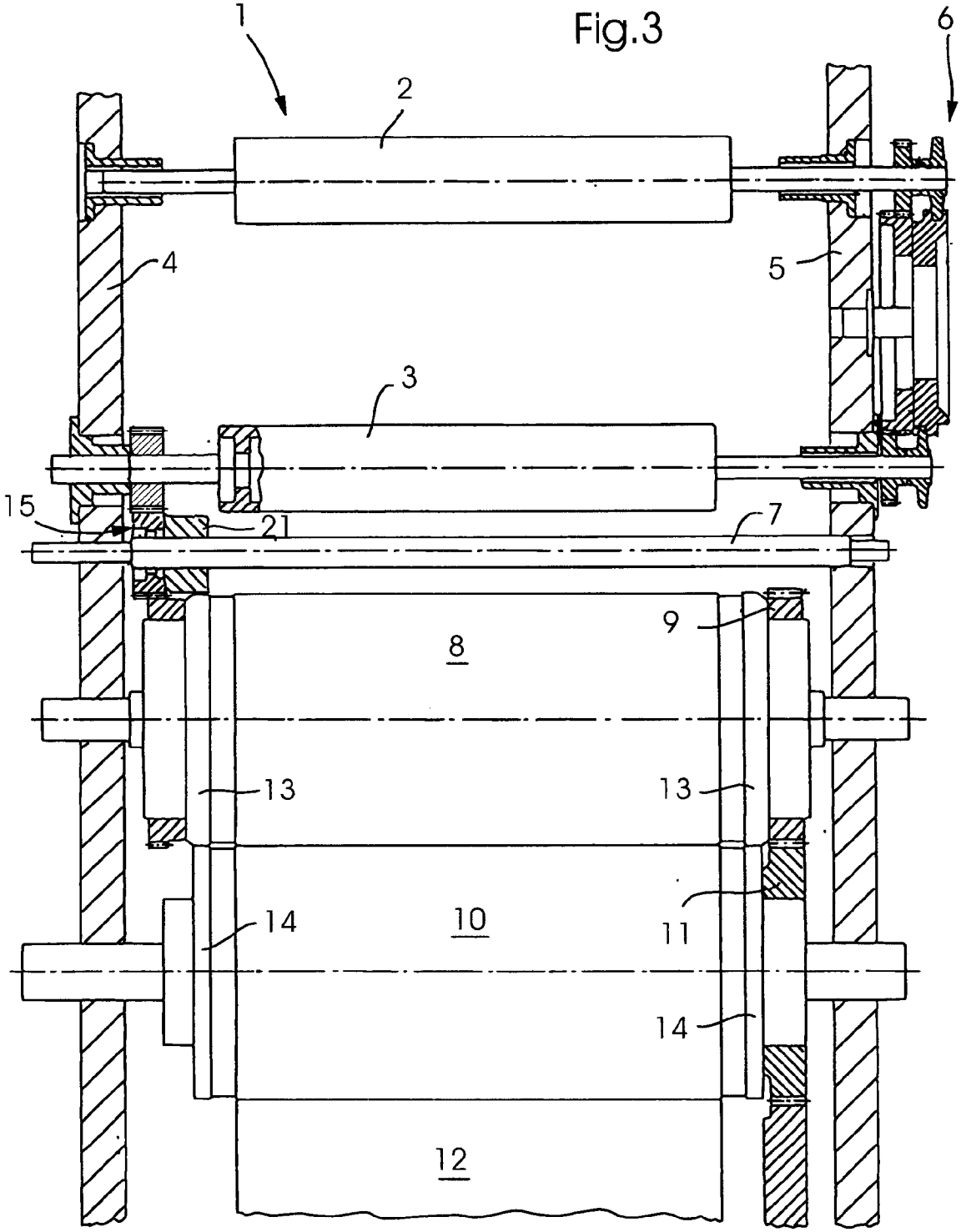
FIGS. 3 and 4 are fragmentary diagrammatic views of FIG. 1 showing alternative dispositions of the clutch on a control shaft and on a printing-unit cylinder shaft, respectively.
Figure 4:
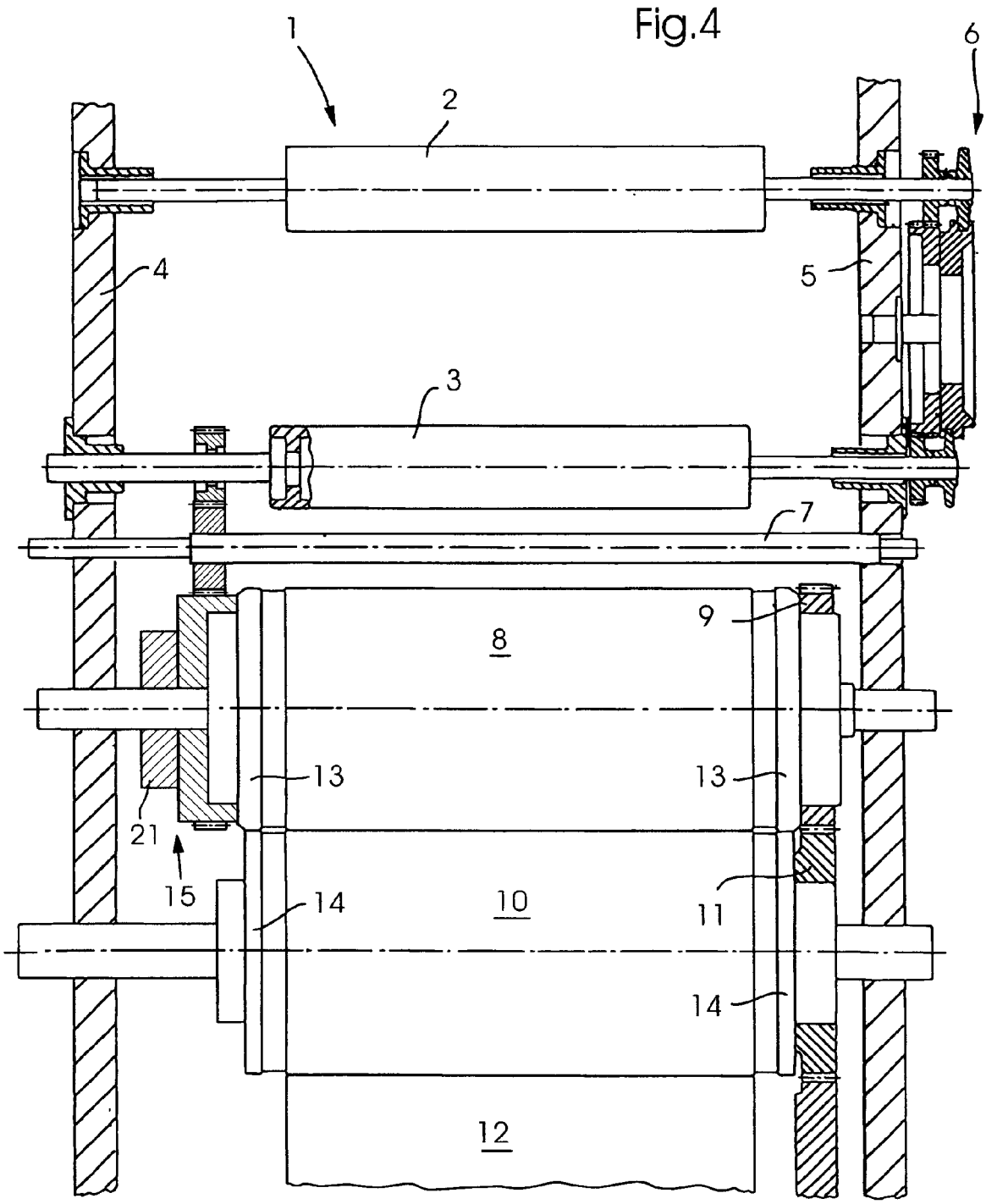

Instead of providing the illustrated clutch system 15 on the shaft of the distributor roller 3, the clutch system 15 may, of course, also be disposed on the control shaft 7, as shown diagrammatically in FIG. 3, so that the engagement and disengagement, respectively, of the drive of the inking unit 1 may be effected at the ratchet gear 7.1. It is also conceivable to provide the clutch system 15, instead, on the journal of the printing-form cylinder 8, as shown in FIG. 4, in order to disconnect the drive of the inking unit 1 and to reestablish it, respectively.

Figure 2:
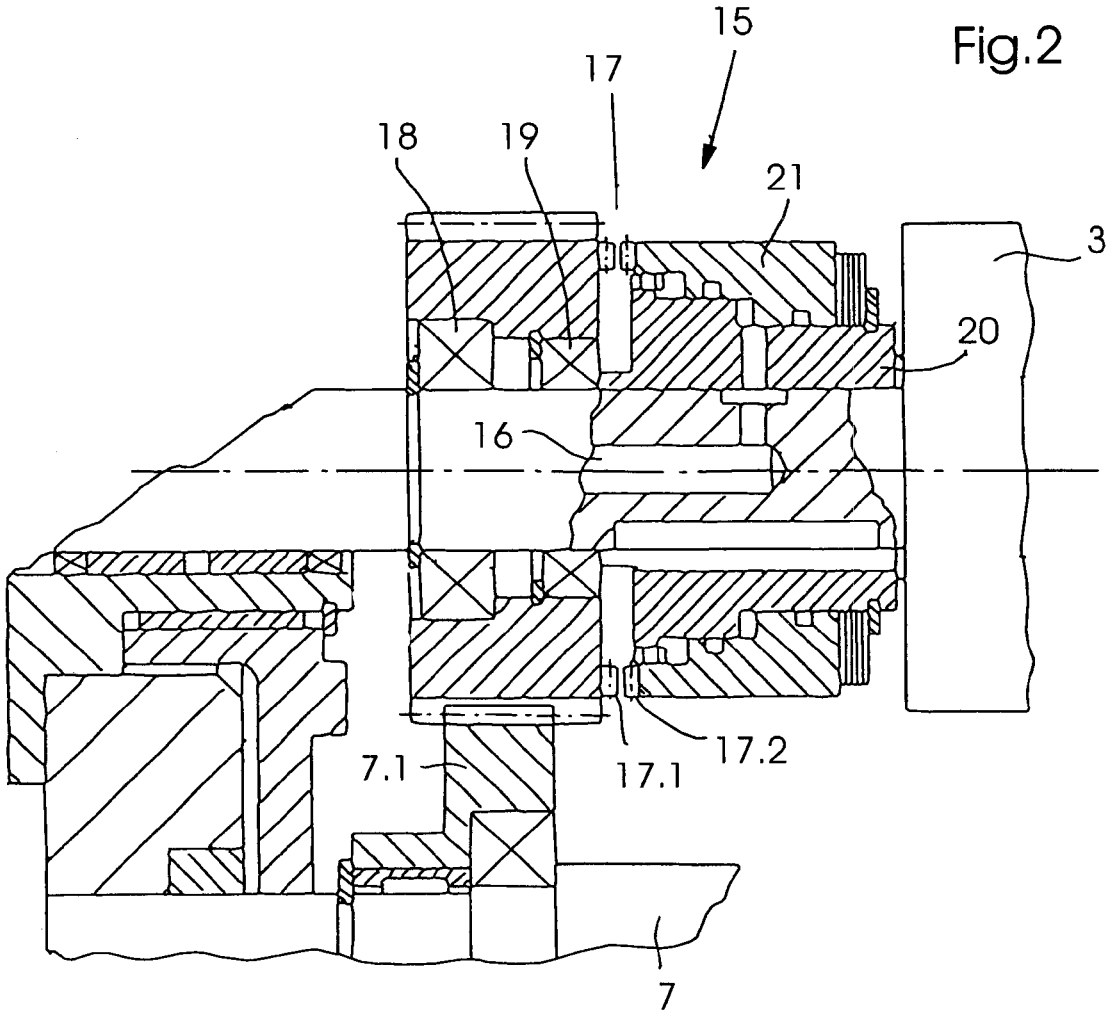
FIG. 2 is an enlarged fragmentary view of FIG. 1 showing the clutch thereof actuated by pressure medium.

FIG. 2 is an enlarged view of the clutch system 15.

Via the ratchet gear 7.1, the drive is transmitted to the distributor roller 3 and therefrom to the inking unit 1, as mentioned hereinbefore. The clutch system 15 is formed of clutch surfaces 17.1 provided on a gearwheel, and clutch surfaces 17.2 provided on a clutch bushing 21 which is axially movable on a clutch body 20. In this regard, the journal of the distributor roller 3 is equipped with an air lead-in 16 for supplying pressure medium to a hollow space formed in the clutch body 20, thereby bringing the clutch surfaces 17.1 and 17.2 axially in and out of engagement. With the ratchet gear 7.1 of the control shaft 7 in engaged condition, the drive is transmitted from the distributor roller 3 to the gearwheel formed with the clutch surfaces 17.1 and which is mounted via bearings 18 and 19 on the journal of the distributor roller 3. Via the clutch surfaces 17.2 provided on the clutch bushing 21, the drive is transmitted to the clutch body 20 which, via a form-locking or positive connection, is connected to the journal of the distributor roller 3. In regard to the foregoing, it is noted that a form-locking connection serves to connect two elements together as a result of the shape of the elements themselves, as opposed to a force-locking connection, which locks the elements together due to a force external to the elements.

Instead of a pneumatically acting clutch, it is also conceivable to use an hydraulic or an electromagnetic clutch, which would have the same attainable effect.

What is claimed is:

1. Method of influencing ink-trapping behavior of ink-conducting components of a printing unit in a rotary printing press, which comprises disconnecting at a clutch location an inking-unit drive coming from printing-unit cylinders from an inking-unit of a rotary printing press; directly imaging a printing form on a printing-form cylinder within the rotary printing press; and reestablishing the drive connection between the inking unit and the printing-unit cylinders at the clutch location after completing the direct imaging of the printing form.

2. In a rotary printing press, a device for performing a method of influencing ink-trapping behavior of ink-conducting components of a printing unit, comprising:

an inking unit of a direct imaging rotary printing press;

a clutch system disconnectably connecting, at a clutch location, an inking-unit drive coming from printing-unit cylinders of the printing unit from said inking-unit, said clutch system including an axially acting clutch subjected to a pressure medium; and said printing-unit cylinders including a blanket cylinder, an impression cylinder and a printing form cylinder to be directly imaged.

3. Device according to claim 2, wherein said clutch is of a type actuatable by a pressure medium.

4. Device according to claim 2, wherein said clutch is an electromagnetically actuatable clutch.

5. Device according to claim 2, wherein said clutch is disposed on a shaft of a distributor roller.

6. Device according to claim 2, wherein said clutch is disposed on a control shaft.

7. Device according to claim 2, wherein said clutch is mounted on a journal of said printing form cylinder.

* * * * *